US011242990B2

(12) United States Patent
Myatlev et al.

(10) Patent No.: US 11,242,990 B2
(45) Date of Patent: Feb. 8, 2022

(54) LINER COOLING STRUCTURE WITH REDUCED PRESSURE LOSSES AND GAS TURBINE COMBUSTOR HAVING SAME

(71) Applicant: DOOSAN HEAVY INDUSTRIES & CONSTRUCTION CO., LTD., Changwon-si (KR)

(72) Inventors: Alexander Myatlev, Gimhae-si (KR); Borys Shershnyov, Changwon-si (KR)

( * ) Notice: Subject to any disclaimer, the term of this patent is extended or adjusted under 35 U.S.C. 154(b) by 98 days.

(21) Appl. No.: 16/819,015

(22) Filed: Mar. 13, 2020

(65) Prior Publication Data

US 2020/0326069 A1 Oct. 15, 2020

(30) Foreign Application Priority Data

Apr. 10, 2019 (KR) ..... 10-2019-0041966

(51) Int. Cl.

| | |
|---|---|
| ***F23M 5/08*** | (2006.01) |
| ***F23R 3/00*** | (2006.01) |
| ***F01D 9/02*** | (2006.01) |

(52) U.S. Cl.

CPC ..... *F23M 5/085* (2013.01); *F01D 9/023* (2013.01); *F23R 3/002* (2013.01); *F23R 3/005* (2013.01); *F05D 2260/22141* (2013.01); *F23R 2900/03041* (2013.01); *F23R 2900/03043* (2013.01); *F23R 2900/03045* (2013.01)

(58) Field of Classification Search

CPC .. F23R 3/002; F23R 3/005; F23R 3/04; F23R 3/46; F23R 3/06; F23R 2900/03041–03045; F01D 9/023; F05D 2260/22141

See application file for complete search history.

(56) References Cited

U.S. PATENT DOCUMENTS 3,736,747 A * 6/1973 Warren ..... F23R 3/04 60/732
3,826,077 A * 7/1974 Quigg ..... F23R 3/005 60/776

(Continued)

FOREIGN PATENT DOCUMENTS

CN 102444476 A 5/2012
JP H1082527 A 3/1998

(Continued)

*Primary Examiner* — Alain Chau
(74) *Attorney, Agent, or Firm* — Harvest IP Law, LLP

(57) ABSTRACT

A liner cooling structure of a duct assembly reduces pressure loss generated in the compressed air flow for cooling the liner. The duct assembly includes a liner, a transition piece, and a flow sleeve, and the transition piece and the flow sleeve form a transition piece channel through which a main stream of compressed air is introduced to the duct assembly. The liner cooling structure includes a first flow passage through which the main stream of compressed air passes in a first direction; and a second flow passage formed as a plurality of inlet holes in the flow sleeve to communicate with the first flow passage and configured to pass an auxiliary stream of compressed air in a second direction from outside the flow sleeve to inside the flow sleeve, the auxiliary stream joining the main stream such that the second direction forms an acute angle with the first direction.

13 Claims, 6 Drawing Sheets

(56) References Cited

U.S. PATENT DOCUMENTS 6,468,669 B1 * 10/2002 Hasz ..... B32B 15/01 428/553
7,685,823 B2 * 3/2010 Martling ..... F23R 3/04 60/760
8,166,764 B2 5/2012 Chokshi et al.
8,359,867 B2 * 1/2013 Chila ..... F23R 3/44 60/752
8,453,460 B2 6/2013 Dugar et al.
8,516,822 B2 8/2013 Chen et al.
8,677,759 B2 * 3/2014 Kaleeswaran ..... F23R 3/04 60/772
8,915,087 B2 * 12/2014 McMahan ..... F23R 3/005 60/772
9,182,122 B2 11/2015 Matthews et al.
10,139,108 B2 11/2018 Thackway et al.
2005/0144953 A1 * 7/2005 Martling ..... F23R 3/04 60/752
2006/0042255 A1 * 3/2006 Bunker ..... F01D 25/14 60/752
2009/0139238 A1 * 6/2009 Martling ..... F23R 3/54 60/740
2010/0071382 A1 * 3/2010 Liang ..... F23R 3/06 60/806
2010/0170256 A1 * 7/2010 Kaleeswaran ..... F23R 3/005 60/754
2010/0186415 A1 * 7/2010 Brown ..... F23R 3/04 60/755
2011/0108257 A1 * 5/2011 Miyake ..... F01D 25/12 165/168
2011/0214429 A1 * 9/2011 Chen ..... F23R 3/04 60/755
2012/0198855 A1 8/2012 Cihlar et al.
2012/0297784 A1 * 11/2012 Melton ..... F23R 3/48 60/772
2012/0324897 A1 * 12/2012 McMahan ..... F23R 3/005 60/752
2013/0074505 A1 * 3/2013 Toronto ..... F23R 3/005 60/746
2013/0086920 A1 * 4/2013 Chen ..... F23R 3/04 60/782
2013/0086921 A1 * 4/2013 Matthews ..... F23R 3/005 60/782
2013/0111909 A1 * 5/2013 Khan ..... F23R 3/002 60/752

FOREIGN PATENT DOCUMENTS

JP 2000088252 A 3/2000
JP 3069522 B2 7/2000
JP 2010203440 A 9/2010
JP 2011220335 A 11/2011
JP 2017533400 A 11/2017
KR 20010085488 A 9/2001

* cited by examiner

LINER COOLING STRUCTURE WITH REDUCED PRESSURE LOSSES AND GAS TURBINE COMBUSTOR HAVING SAME

CROSS REFERENCE TO RELATED APPLICATION

The present application claims priority to Korean Patent Application No. 10-2019-0041966, filed on Apr. 10, 2019, the entire contents of which are incorporated herein for all purposes by this reference.

FIELD OF THE DISCLOSURE

The present disclosure relates to a combustor for a gas turbine and, more particularly, to a liner cooling structure for reducing the pressure drop phenomenon of the compressed air flow for cooling the liner of the gas turbine combustor.

BACKGROUND OF THE DISCLOSURE

Generally, a gas turbine combustor is provided between a compressor and a turbine to mix compressed air from a compressor with fuel, combust the air-fuel mixture at constant pressure to produce high energy combustion gas, and transmit the combustion gases to a turbine, which in turn converts heat energy of the combustion gas into mechanical energy.

Such combustors include a duct assembly typically formed by a flow sleeve surrounding a liner and a transition piece. The liner defines a combustion chamber, the transition piece is connected to one end of the liner, and the flow sleeve forms an inner annular space around the liner and the transition piece. Inlet holes are provided in the flow sleeve to communicate with the inner annular space of the flow sleeve.

During combustor operation, the liner and transition piece come into direct contact with the hot combustion gas. To cool the liner and transition piece, a portion of the compressed air supplied from the compressor may be directed into the inlet holes and joins with compressed air passing through the inner annular space while in contact with outer surfaces of the liner and transition piece. As the compressed air passing through the inner annular space collides with that passing through the inlet holes, there is a significant pressure loss (pressure loss) that restricts efficient cooling of the liner.

SUMMARY OF THE DISCLOSURE

An objective of the present disclosure is to improve the cooling performance of a liner of a duct assembly of a gas turbine by reducing the pressure loss generated in the compressed air flow for cooling the liner so that the liner can perform its function stably at a higher combustion temperature.

In one aspect of the present disclosure, there is provided a liner cooling structure of a duct assembly including a liner, a transition piece connected to the liner, and a flow sleeve surrounding the liner and the transition piece, the transition piece and the flow sleeve forming a transition piece channel through which a main stream of compressed air is introduced to the duct assembly. The liner cooling structure may include a first flow passage through which the main stream of compressed air passes in a first direction; and a second flow passage formed in the flow sleeve to communicate with the first flow passage and configured to pass an auxiliary stream of compressed air in a second direction from an outside of the flow sleeve to an inside of the flow sleeve, the auxiliary stream of compressed air passing in the second direction joining the main stream of compressed air passing in the first direction such that the second direction forms an acute angle with the first direction.

The first flow passage may include an annular space defined by the transition piece channel, and the second flow passage may be disposed around a circumference of the flow sleeve and communicates with the first flow passage around the circumference of the flow sleeve. The second flow passage may include a plurality of inlet holes arranged around the circumference of the flow sleeve and configured to pass the auxiliary stream of compressed air in the second direction. The flow sleeve may include an oblique wall formed around the circumference of the flow sleeve, the oblique wall including a radially outer edge communicating with a downstream portion of the flow sleeve based on a flow direction of compressed air and a radially inner edge communicating with an upstream portion of the flow sleeve, and the plurality of inlet holes may be formed in the oblique wall. The plurality of inlet holes may include a plurality of first row inlet holes arranged toward the radially inner edge of the oblique wall and a plurality of second row inlet holes toward the radially outer edge of the oblique wall. The plurality of first row inlet holes and the plurality of second row inlet holes may be staggered with respect to each other in a radial direction of the flow sleeve.

The second flow passage may further include an auxiliary inlet hole formed in the flow sleeve upstream of the oblique wall, the plurality of inlet holes may be separated from each other by a plurality of support links respectively joining inner and outer sides of each inlet hole, and the auxiliary inlet hole may be disposed at each support link. The plurality of inlet holes may include a plurality of first row inlet holes and a plurality of second row inlet holes. The auxiliary inlet hole, the plurality of first row inlet holes, and the plurality of second row inlet holes may be sequentially arranged in a radial direction of the flow sleeve, such that the auxiliary inlet hole is disposed farthest inward radially and plurality of first row inlet holes, and the plurality of second row inlet holes are disposed farthest outward radially.

The liner cooling structure may further include a plurality of ribs protruding into the first flow passage from an outer surface of the liner, the plurality of ribs arranged around a circumference of the liner. Each of plurality of ribs may extend in a longitudinal direction of the liner and may be configured to guide the main stream of compressed air through the first flow passage into the second flow passage. The plurality of ribs may include a plurality of rows of ribs, each row arranged in an annular pattern around the circumference of the liner, and the plurality of rows of ribs may be separately disposed from each other along a longitudinal direction of the liner.

The annular pattern of each of the plurality of rows of ribs may be staggered with the annular pattern of an adjacent row of ribs of the plurality of rows of ribs. The plurality of rows of ribs may include a farthest downstream row of ribs, and the second flow passage may be further configured to direct the auxiliary stream of compressed air toward the farthest downstream row of ribs.

The liner cooling structure may further include an annular transverse rib extending in a circumferential direction of the liner, and the annular transverse rib may be disposed between adjacent rows of the plurality of rows of ribs. The annular transverse rib may protrude into the first flow passage from the outer surface of the liner and may have a height that is less than a height of the ribs, and the annular transverse rib may be configured to radially disturb the main stream of compressed air.

The plurality of ribs may be made of a material having a thermal conductivity greater than a thermal conductivity of the liner.

In another aspect of the present disclosure, there is provided a liner cooling structure of a duct assembly including a liner, a transition piece connected to the liner, and a flow sleeve surrounding the liner and the transition piece, the transition piece and the flow sleeve forming a transition piece channel through which a main stream of compressed air is introduced to the duct assembly. The liner cooling structure may include a first flow passage through which the main stream of compressed air passes in a first direction; an oblique wall formed around the circumference of the flow sleeve, the oblique wall including a radially outer edge communicating with a downstream portion of the flow sleeve based on a flow direction of compressed air and a radially inner edge communicating with an upstream portion of the flow sleeve; and a second flow passage formed in the oblique wall of the flow sleeve to communicate with the first flow passage and configured to pass an auxiliary stream of compressed air in a second direction from outside the flow sleeve to inside the flow sleeve. Here, the auxiliary stream of compressed air passing in the second direction may join the main stream of compressed air passing in the first direction such that the second direction forms an acute angle with the first direction, and the second flow passage may include a plurality of inlet holes arranged around the circumference of the flow sleeve and configured to pass the auxiliary stream of compressed air in the second direction and an auxiliary inlet hole formed in the flow sleeve upstream of the oblique wall.

In another aspect of the present disclosure, there is provided a combustor for a gas turbine. The combustor may include a duct assembly including a liner, a transition piece connected to the liner, and a flow sleeve surrounding the liner and the transition piece, the transition piece and the flow sleeve forming a transition piece channel through which a main stream of compressed air is introduced to the duct assembly; and a liner cooling structure connected to the duct assembly, wherein the liner cooling structure is consistent with either of the above liner cooling structures.

According to the liner cooling structure, since the main flow passing through the transition piece channel and the auxiliary flow through the inlet holes of the flow sleeve are joined at an acute angle, the pressure loss can be reduced and the hot main flow and the relatively cold (cooler) auxiliary flow can be mixed smoothly.

Therefore, the liner cooling structure of the present disclosure improves the cooling efficiency of the liner by significantly reducing the angle at which the auxiliary flow meets the main flow. The reduced angle is an acute angle in contrast to a virtually perpendicular angle exhibited in contemporary duct assemblies. In doing so, the liner cooling structure of the present disclosure can cope with combustion temperatures that are likely to continue to rise for increasing the efficiency of the gas turbine.

DETAILED DESCRIPTION OF THE DISCLOSURE

Figure 1:
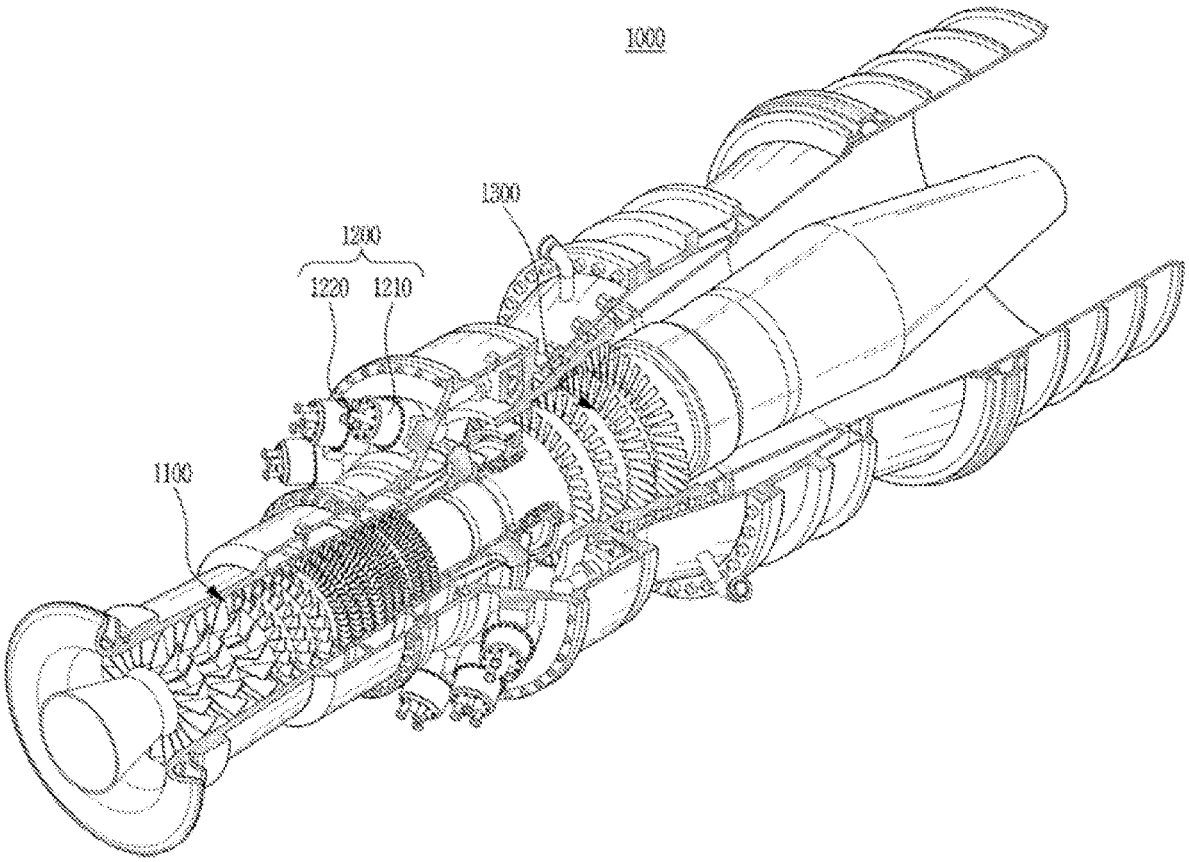
FIG. 1 is a cutaway perspective view of an example of a gas turbine to which a liner cooling structure may be applied according to an embodiment of the present disclosure.

As the present disclosure allows for various changes and numerous embodiments, particular embodiments will be illustrated and described in detail in the detailed description. However, it should be understood that this is not intended to limit the present disclosure to the specific embodiments, but may include all transformations, equivalents, and substitutes included in the spirit and scope of the present disclosure.

The terminology used herein is for the purpose of describing particular embodiments only and is not intended to be limiting the present disclosure. Singular expressions include plural expressions unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Reference will now be made in greater detail to a preferred embodiment of the present disclosure, an example of which is illustrated in the accompanying drawings. Wherever possible, the same reference numerals will be used throughout the drawings and the description to refer to the same or like parts. In the following description, it is to be noted that, when the functions of conventional elements and the detailed description of elements related with the present disclosure may make the gist of the present disclosure unclear, a detailed description of those elements will be omitted. In addition, some elements shown in the drawings may be exaggeratedly drawn to provide an easily understood description of the structure of the present disclosure.

An ideal thermodynamic cycle of a gas turbine follows a Brayton cycle. The Brayton cycle consists of four thermodynamic processes: an isentropic compression (adiabatic compression), an isobaric combustion, an isentropic expansion (adiabatic expansion) and isobaric heat ejection. That is, in the Brayton cycle, atmospheric air is sucked and compressed into high pressure air, mixed gas of fuel and compressed air is combusted at constant pressure to discharge heat energy, heat energy of hot expanded combustion gas is converted into kinetic energy, and exhaust gases containing remaining heat energy is discharged to the outside. That is, gases undergo four thermodynamic processes: compression, heating, expansion, and heat ejection.

Since heat efficiency in the Brayton cycle increases as compression ratio of air increases and as turbine inlet temperature (TIT) of the combustion gas introduced during isentropic expansion increases, gas turbines are being designed with ever increasing compression ratios and turbine inlet temperatures.

Referring to FIG. 1, a gas turbine 1000 for realizing the Brayton cycle includes a compressor 1100, combustor 1200, and a turbine 1300. High temperature, high pressure combustion gas generated by the combustor 1200 is supplied to the turbine 1300 through a duct assembly (described later). In the turbine 1300, the combustion gas undergoes adiabatic expansion and impacts and drives a plurality of blades arranged radially around a rotary shaft so that heat energy of the combustion gas is converted into mechanical energy with which the rotary shaft rotates. A portion of the mechanical energy obtained from the turbine 1300 is supplied as the energy required to compress the air in the compressor, and the rest is utilized as an available energy to drive a generator to produce electric power.

The compressor 1100, which draws in and compresses air, serves to supply the compressed air for combustion to a combustor 1200 and to supply the compressed air for cooling to a high temperature region of the gas turbine 1000. As the drawn air undergoes an adiabatic compression process in the compressor 1100, the air passing through the compressor 1100 has increased pressure and temperature. Since the gas turbine 1000 exemplified in FIG. 1 is a large-scale gas turbine, its compressor 1100 may be a multi-stage axial compressor that compresses a great amount of air to a target compression ratio through multiple stages.

The combustor 1200 serves to mix the compressed air supplied from an outlet of the compressor 1100 with fuel and combust the mixture at constant pressure to produce hot combustion gases. The combustor 1200 is disposed downstream of the compressor 1100 such that a plurality of burners 1220 is disposed along an inner circumference of a combustor casing 1210.

Figure 2:
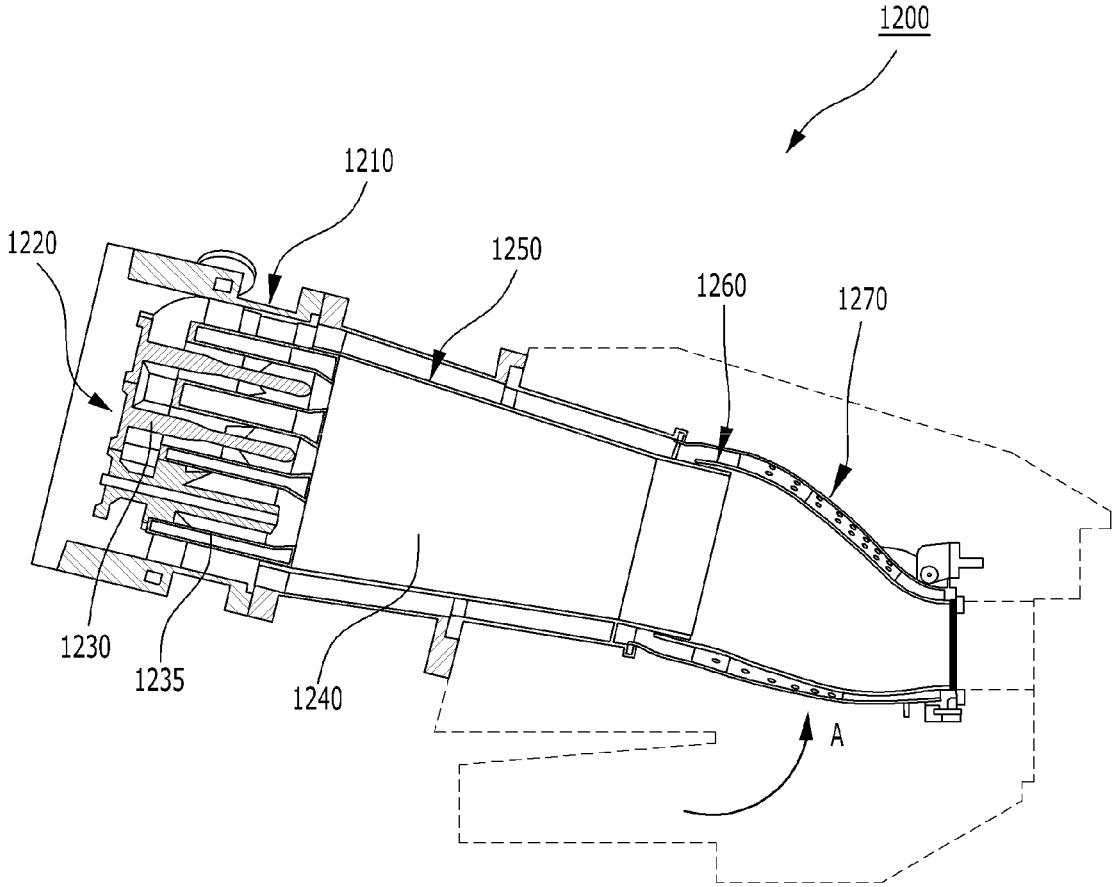
FIG. 2 is a sectional view of a general structure of a combustor of the gas turbine of FIG. 1.

FIG. 2 illustrates one combustor of the combustor 1200 of FIG. 1.

Referring to FIG. 2, each burner 1220 has several combustion nozzles 1230, through which fuel is sprayed into and mixed with air in a proper ratio to form a fuel-air mixture suitable for combustion. The combustor 1200 is provided with a duct assembly to connect one burner 1220 and to a corresponding portion of the turbine 1300 such that the duct assembly is heated by hot combustion gas. As such, the duct assembly should be properly cooled.

The gas turbine 1000 may use gas fuel, liquid fuel, or a combination thereof. In order to create a combustion environment for reducing emissions such as carbon monoxides, nitrogen oxides, etc. as a target of regulation, recently manufactured gas turbines have a tendency to apply premixed combustion that is advantageous in reducing emissions through lowered combustion temperature and homogeneous combustion despite its relatively difficult combustion control.

In premixed combustion, after compressed air is previously mixed with fuel sprayed from the combustion nozzles 1230, the mixture is supplied to a combustion chamber 1240. When the premixed gas is initially ignited by an ignitor and then the combustion state is stabilized, the combustion state is maintained by supplying fuel and air.

The combustor has a highest temperature environment in gas turbines and thus needs suitable cooling. Particularly, turbine inlet temperature (TIT) is an important factor in gas turbines, since the higher TIT is, the greater the gas turbine's operating efficiency is. Further, as TIT increases, it is advantageous to gas-turbine-combined power generation. Thus, TIT is also used as a reference to determine classes (grades) of a gas turbine. Since temperature of combustion gas should be increased in order to increase TIT, it is important to design the combustion chamber and its accompanying duct assembly, which is provided with a cooling path for cooling the duct assembly, to exhibit high heat resistance and facilitated cooling.

Referring further to FIG. 2, the duct assembly of the combustor 1200 includes a liner 1250, a transition piece 1260, and a flow sleeve 1270. The duct assembly has a double-wall structure in which the flow sleeve 1270 surrounds the liner 1250 and the transition piece 1260, which are connected by means of an elastic support 1280, wherein compressed air (A) is introduced into an inner annular space of the flow sleeve 1270 to cool the liner 1250 and the transition piece 1260.

The liner 1250 is a tube member connected to the section of the burners 1220 of the combustor 1200, wherein an internal space of the liner 1250 defines the combustion chamber 1240. The transition piece 1260, which is connected to the liner 1250, is connected to an inlet of the turbine 1300 to guide the hot combustion gas towards the turbine 1300. The flow sleeve 1270 serves both to protect the liner 1250 and the transition piece 1260 and to prevent high temperature heat from being discharged directly towards the outside.

Particularly, since the liner 1250 and the transition piece 1260 come into direct contact with the hot combustion gas, they should be properly cooled. To this end, the liner 1250 and the transition piece 1260 are protected from the hot combustion gas through a cooling method using the compressed air. With respect to the direction of combustion gas flow through the duct assembly, the upstream end of the liner 1250 is fastened to the combustor 200 and the downstream end of the transition piece 1260 is fastened to the turbine 1300. Because of this fixed state of each of the liner 1250 and the transition piece 1260, the elastic support 1280 supports the liner 1250 and the transition piece 1260 with a structure capable of accommodating heat expansion in the longitudinal and radial directions.

The duct assembly of FIG. 2 includes the liner 1250, the transition piece 1260 connected to the liner 1250, and the flow sleeve 1270 surrounding the liner 1250 and the transition piece 1260. The transition piece 1260 and the flow sleeve 1270 form a transition piece channel 100 (FIG. 3) through which a main stream of compressed air is introduced to the duct assembly. The duct assembly includes a liner cooling structure according to the present disclosure in which a portion of the compressed air supplied from the compressor 1100 is directed into inlet holes formed in the flow sleeve 1270 surrounding the liner 1250, and the compressed air passing through the inlet holes joins with compressed air passing through an annular space defined by the transition piece channel 100.

In other words, two flow paths exist. These include a main flow path through a first flow passage and a second flow path through a second flow passage. The first flow passage of the liner cooling structure according to the present disclosure includes a structure through which the main stream of compressed air passes in a first direction, namely, downstream toward the burner 1220 of the combustor 1200 in a longitudinal or axial direction. The first flow passage includes an annular space defined by the transition piece channel 100, and the second flow passage is disposed around a circumference of the flow sleeve 1270 and communicates with the first flow passage around the circumference of the flow sleeve 1270. The second flow passage of the liner cooling structure according to the present disclosure includes a structure through which an auxiliary stream of compressed air passes in a second direction from an outside of the flow sleeve 1270 to an inside of the flow sleeve 1270.

The auxiliary stream is supplied to the duct assembly independent of the main stream.

The compressed air of the auxiliary flow path transits the inlet holes in a radial direction and tends to collide with the compressed air in the main flow path in the longitudinal or axial direction. The collision can cause a significant pressure drop (pressure loss) and as such can restrict efficient cooling of the liner, which in turn can restrict efforts to increase combustion temperature in order to raise the turbine inlet temperature.

The present disclosure is devised to solve these problems and will be described in detail with reference to FIGS. 3 to 6.

Figure 3:
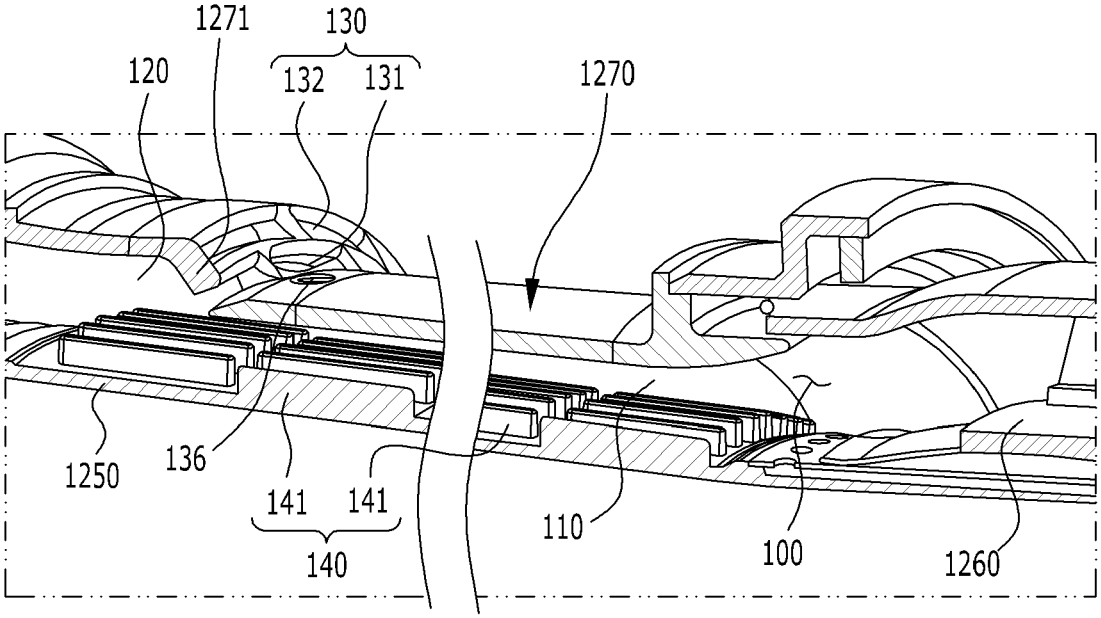
FIG. 3 is a cutaway perspective view of the liner cooling structure according to an embodiment of the present disclosure.

FIG. 3 illustrates the overall structure of the liner cooling structure according to an embodiment of the present disclosure. Referring to FIG. 3, the liner cooling structure includes first and second flow passages 110 and 120 for cooling the liner 1250 so that, particularly, a pressure loss occurring when streams of compressed air flowing independently through the first flow passage 110 and the second flow passage 120 join each other may be reduced.

The first flow passage 110 is configured to supply compressed air through the transition piece channel 100 defined by an annular space between the transition piece 1260 and the flow sleeve 1270. The second flow passage 120 is formed in the flow sleeve 1270 to communicate with the first flow passage and is configured to pass the auxiliary stream of compressed air such that the auxiliary stream of compressed air passing in the second direction joins the main stream of compressed air passing in the first direction such that the second direction forms an acute angle with the first direction. As such, the second flow passage 120 is disposed so as to extend at an acute angle with respect to the compressed air flowing through the first flow passage 110 while following the same general downstream direction as the compressed air flowing through the transition piece channel 100.

That is, since the compressed air in the second flow passage 120 joins in the transition piece channel 100 at an acute angle with respect to the compressed air flowing through the first flow passage 110, compared to contemporarily configured duct assemblies in which streams of compressed air join each other orthogonally along longitudinal and radial directions, the pressure loss generated is greatly reduced.

In addition, an insufficient mixing problem that may occur when the compressed air flows along the first flow passage 110 and the second flow passage 120 are made parallel with each other to reduce the pressure loss does not occur. Therefore, the hot compressed air heated during flowing through the first flow passage 110 and the relatively low temperature compressed air flowing through the second flow passage 120 are smoothly mixed to lower the overall temperature, thereby efficiently cooling the downstream hot region of the liner 1250 close to a burner. Here, upstream and downstream directions are based on the flow of compressed air, so that in the duct assembly, the liner 1250 is positioned downstream from the transition piece 1260. The same criteria will be applied below.

More specifically, the second flow passage 120 includes a plurality of inlet holes 130 arranged in the circumferential direction, wherein the compressed air is supplied towards the first flow passage 110 through the inlet holes 130. A downstream portion of the flow sleeve 1270 is circumferentially enlarged in order to form the second flow passage 120 inclined at an acute angle with respect to the first flow passage 110.

The flow sleeve 1270 of the present disclosure includes an oblique wall 1271 formed around the circumference of the flow sleeve 1270. The oblique wall 1271 includes a radially outer edge communicating with a downstream portion of the flow sleeve 1270 and a radially inner edge communicating with an upstream portion of the flow sleeve 1270. The plurality of inlet holes 130 are formed in the oblique wall 1271.

Figure 4:
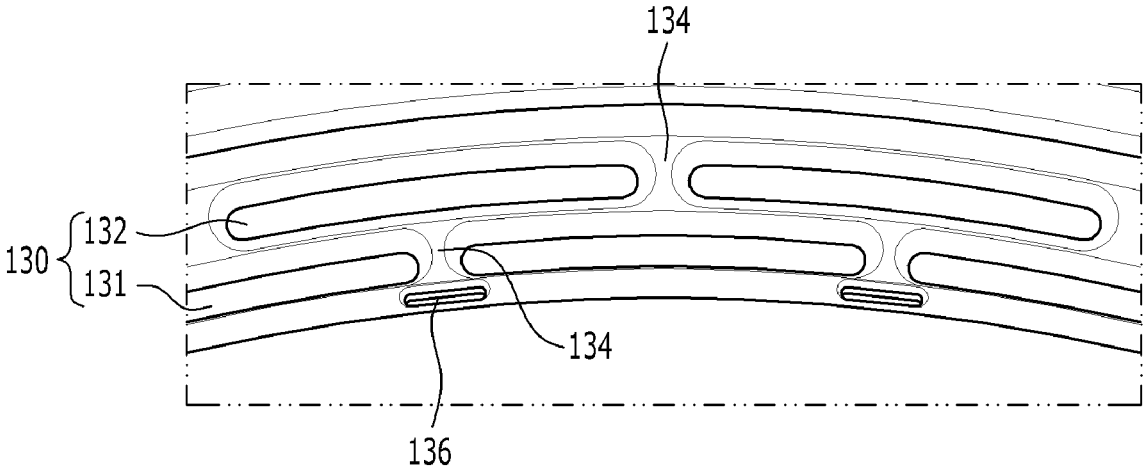
FIG. 4 is a sectional view of inlet holes forming a second flow path.

Referring to FIG. 4, the plurality of inlet holes 130 consists of a first row of inlet holes 131 and a second row of inlet holes 132 arranged radially outward with respect to the first row of inlet holes 131. The first row of inlet holes 131 are formed such that one side of each inlet hole 131 occurs at the radially inner edge of the oblique wall. The inlet holes 131 and 132 are arranged around the entire circumference of the flow sleeve 1270 surrounding the liner 1250.

The arrangement of plural rows of the inlet holes 130 is provided because, assuming that each inlet hole 130 has the same overall cross-sectional area, an increase in the number of the inlet holes 130 allows an increase in the number of links 134 connecting adjacent inlet holes 130, thereby structurally reinforcing the oblique wall 1271 and its inlet holes 130 and advantageously supplying the compressed air.

In addition, the first row of inlet holes 131 and the second row of inlet holes 132 may have a staggered pattern in a radial direction. That is, the first row of inlet holes 131 and the second row of inlet holes 132 are staggered so as not to coincide in the radial direction. The staggered structure is such that the two rows of links 134 between the inlet holes 130 are alternately arranged in the radial direction so that the supporting structure becomes more reinforced, and even though potential regions of air passage are blocked by the links 134, as a whole, the two rows of inlet holes 130 advantageously further reduce the pressure drop while supplying compressed air uniformly along the circumferential direction.

In addition, the liner cooling structure of the present disclosure may be further provided with auxiliary inlet holes 136 in the radially inward direction on the links 134 for connecting the adjacent inlet holes 131 in the first row. More particularly, the second flow passage further includes, in addition to the inlet holes 131 and 132, an auxiliary inlet hole 136 formed in the flow sleeve 1270 upstream of the oblique wall 1271. Thus, the auxiliary inlet hole 136 is located upstream of the first row of inlet hole 131 (see FIG. 4) so as to be the first inlet hole of the second flow passage to face the compressed air in the transition piece channel 100. The compressed air thus preliminarily supplied through the auxiliary inlet holes 136 causes some disturbance to the compressed air along the first flow passage 110, enabling the auxiliary flow of compressed air through the first and second rows of inlet holes 131 and 132 to be more easily mixed with the compressed air through the first flow passage 110 without much resistance. That is, the auxiliary inlet holes 136 serve to further reduce the pressure loss during mixing of the streams of compressed air.

Meanwhile, a plurality of ribs 140 may be circumferentially provided on the surface of the liner 1250 to extend in the longitudinal direction of the liner. The rib 140 serves to guide and cool the compressed air flow through the first flow passage 110, thereby improving the cooling efficiency of the liner 1250. In order to increase the cooling efficiency, it may be desirable that the rib 140 be formed of a material having a higher thermal conductivity than that of the liner 1250.

Figure 5:
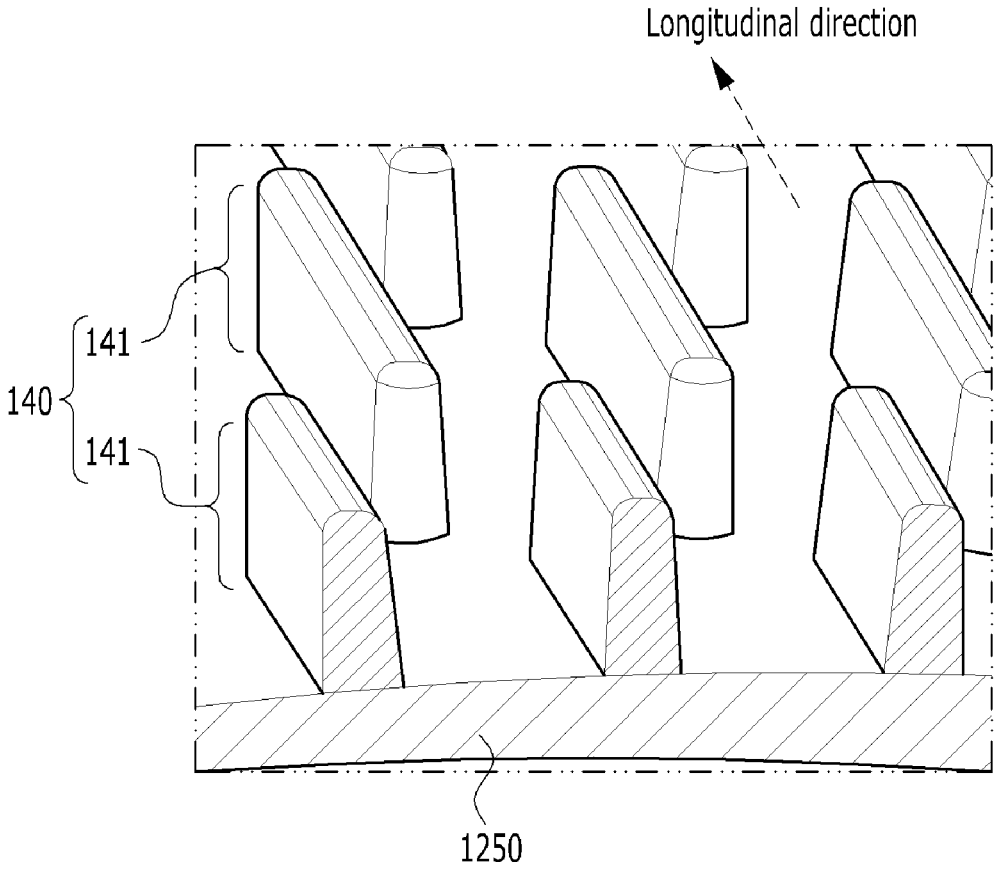
FIG. 5 is a perspective view of a configuration of ribs provided in the liner.
Figure 6:
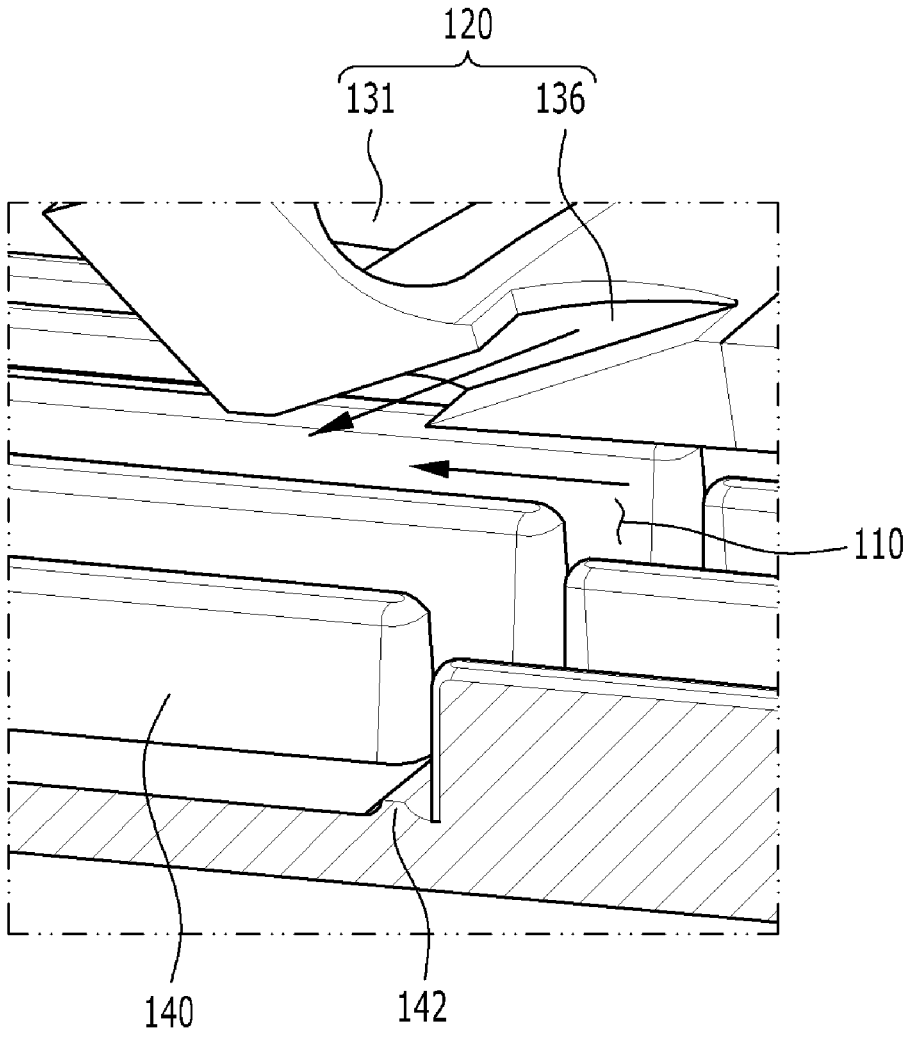
FIG. 6 is a perspective view of a structural relationship between the second flow path and the ribs provided in the liner.

Referring to FIGS. 5 and 6, the ribs 140 may be arranged in rows 141 along the longitudinal direction. Here, an annular transverse rib 142 extending in the circumferential direction may be further provided between adjacent rows 141 of ribs. The height of the transverse rib 142 is preferably significantly smaller than the height of the rib 140 so as not to interfere with the flow of compressed air flowing through the first flow passage 110. The transverse rib 142 serves to radially disturb the flow of compressed air guided in the longitudinal direction, thereby improving the cooling efficiency.

In addition, the ribs 140 of each row 141 may be alternately arranged with respect to the ribs 141 of adjacent row 141. This arrangement causes the compressed air flows along the longitudinal direction to partially exchange with each other along the circumferential direction when passing out of (exiting) the rows of ribs, thereby contributing to a reduction in local temperature variations.

As shown in FIG. 6, the plurality of inlet holes 130 of the second flow passage 120 through which the compressed air is introduced from the outside of the flow sleeve 1270 toward the transition piece channel 100 are located downstream of the bulk of the ribs 140. This is because the mixing of the relatively low temperature compressed air of the second flow passage 120 with the compressed air of the first flow passage 110 heated during sufficient cooling of an upstream part of the liner 1250 is also advantageous in terms of cooling efficiency. The high temperature region downstream of the liner 1250 beyond the ribs 140 is cooled by a sufficient flow rate of the compressed air of the first flow passage 110 and the second flow passage 120 joined together.

In another aspect, the present disclosure provides a gas turbine combustor 1200 in which each burner 1220 of FIG. 1 includes a duct assembly having a liner 1250, a transition piece 1260 connected thereto, and a flow sleeve 1270 surrounding them, wherein the liner cooling structure as described above is provided for each burner 1220.

As mentioned above, although exemplary embodiments of the present disclosure have been described, those skilled in the art may diversely modify and change the disclosed invention by addition, change, or deletion of components without departing from the spirit of the present disclosure described in the claims, and such modifications and changes will also be included within the scope of the claims.

What is claimed is:

1. A liner cooling structure of a duct assembly comprising a liner, a transition piece connected to the liner, and a flow sleeve surrounding the liner and the transition piece, the transition piece and the flow sleeve forming a transition piece channel through which a main stream of compressed air is introduced to the duct assembly, the liner cooling structure comprising:

a first flow passage through which the main stream of compressed air passes in a first direction;

a second flow passage formed in the flow sleeve to communicate with the first flow passage and configured to pass an auxiliary stream of compressed air in a second direction from an outside of the flow sleeve to an inside of the flow sleeve, the auxiliary stream of compressed air passing in the second direction joining the main stream of compressed air passing in the first direction such that the second direction forms an acute angle with the first direction;

a plurality of ribs protruding into the first flow passage from an outer surface of the liner, the plurality of ribs arranged around a circumference of the liner, wherein the plurality of ribs includes a plurality of rows of ribs, each row arranged in an annular pattern around the circumference of the liner, wherein the plurality of rows of ribs are separately disposed from each other along a longitudinal direction of the liner, an annular transverse rib extending in a circumferential direction of the liner, the annular transverse rib disposed between adjacent rows of the plurality of rows of ribs, wherein the annular transverse rib protrudes into the first flow passage from the outer surface of the liner and has a height that is less than a height of the ribs, and wherein the annular transverse rib is configured to radially disturb the main stream of compressed air.

2. The liner cooling structure according to claim 1, wherein the first flow passage includes an annular space defined by the transition piece channel, and the second flow passage is disposed around a circumference of the flow sleeve and communicates with the first flow passage around the circumference of the flow sleeve.

3. The liner cooling structure according to claim 2, wherein the second flow passage comprises a plurality of inlet holes arranged around the circumference of the flow sleeve and configured to pass the auxiliary stream of compressed air in the second direction.

4. The liner cooling structure according to claim 3, wherein the flow sleeve includes an oblique wall formed around the circumference of the flow sleeve, the oblique wall including a radially outer edge communicating with a downstream portion of the flow sleeve based on a flow direction of compressed air and a radially inner edge communicating with an upstream portion of the flow sleeve, and wherein the plurality of inlet holes are formed in the oblique wall.

5. The liner cooling structure according to claim 4, wherein the plurality of inlet holes include a plurality of first row inlet holes arranged toward the radially inner edge of the oblique wall and a plurality of second row inlet holes toward the radially outer edge of the oblique wall.

6. The liner cooling structure according to claim 5, wherein the plurality of first row inlet holes and the plurality of second row inlet holes are staggered with respect to each other in a radial direction of the flow sleeve.

7. The liner cooling structure according to claim 4, wherein the second flow passage further comprises an auxiliary inlet hole formed in the flow sleeve upstream of the oblique wall, wherein the plurality of inlet holes are separated from each other by a plurality of support links respectively joining inner and outer sides of each inlet hole, and wherein the auxiliary inlet hole is disposed at each support link.

8. The liner cooling structure according to claim 7, wherein the plurality of inlet holes include a plurality of first row inlet holes and a plurality of second row inlet holes, wherein the auxiliary inlet hole, the plurality of first row inlet holes, and the plurality of second row inlet holes are sequentially arranged in a radial direction of the flow sleeve, and wherein the auxiliary inlet hole is disposed farthest inward radially and the plurality of first row inlet holes, and the plurality of second row inlet holes are disposed farthest outward radially.

9. The liner cooling structure according to claim 1, wherein each of plurality of ribs extends in a longitudinal direction of the liner and is configured to guide the main stream of compressed air through the first flow passage into the second flow passage.

10. The liner cooling structure according to claim 1, wherein the annular pattern of each of the plurality of rows of ribs is staggered with the annular pattern of an adjacent row of ribs of the plurality of rows of ribs.

11. The liner cooling structure according to claim 1, wherein the plurality of rows of ribs includes a farthest downstream row of ribs, and wherein the second flow passage is further configured to direct the auxiliary stream of compressed air toward the farthest downstream row of ribs.

12. The liner cooling structure according to claim 1, wherein the plurality of ribs are made of a material having a thermal conductivity greater than a thermal conductivity of the liner.

13. A combustor for a gas turbine, the combustor comprising:

a duct assembly including a liner, a transition piece connected to the liner, and a flow sleeve surrounding the liner and the transition piece, the transition piece and the flow sleeve forming a transition piece channel through which a main stream of compressed air is introduced to the duct assembly; and a liner cooling structure connected to the duct assembly, the liner cooling structure comprising:

a first flow passage through which the main stream of compressed air passes in a first direction;

a second flow passage formed in the flow sleeve to communicate with the first flow passage and configured to pass an auxiliary stream of compressed air in a second direction from outside the flow sleeve to inside the flow sleeve, the auxiliary stream of compressed air passing in the second direction joining the main stream of compressed air passing in the first direction such that the second direction forms an acute angle with the first direction;

a plurality of ribs protruding into the first flow passage from an outer surface of the liner, the plurality of ribs arranged around a circumference of the liner; and wherein the plurality of ribs includes a plurality of rows of ribs, each row arranged in an annular pattern around the circumference of the liner, wherein the plurality of rows of ribs are separately disposed from each other along a longitudinal direction of the liner, an annular transverse rib extending in a circumferential direction of the liner, the annular transverse rib disposed between adjacent rows of the plurality of rows of ribs, wherein the annular transverse rib protrudes into the first flow passage from the outer surface of the liner and has a height that is less than a height of the ribs, and wherein the annular transverse rib is configured to radially disturb the main stream of compressed air.

* * * * *